US006675722B2

(12) United States Patent
Stathis et al.

(10) Patent No.: US 6,675,722 B2
(45) Date of Patent: Jan. 13, 2004

(54) WORKHORSE TABLE BASE

(76) Inventors: Peter Stathis, 77A Pearl St., San Francisco, CA (US) 94103; Christopher C. Deam, 162 Throckmorton Ave., Mill Valley, CA (US) 94941

( * ) Notice: Subject to any disclaimer, the term of this patent is extended or adjusted under 35 U.S.C. 154(b) by 2 days.

(21) Appl. No.: 10/098,190

(22) Filed: Mar. 13, 2002

(65) Prior Publication Data

US 2003/0172853 A1 Sep. 18, 2003

(51) Int. Cl.[7] ..... A47B 37/00
(52) U.S. Cl. ..... 108/50.02; 108/115
(58) Field of Search ..... 108/50.02, 50.01, 108/115, 23, 50.11, 162, 173, 174, 175, 33, 38, 35, 36; 312/223.6; 182/155

(56) References Cited

U.S. PATENT DOCUMENTS

| | | | | |
|---|---|---|---|---|
| 5,119,903 A | | 6/1992 | Ulshafer, Jr. | |
| 5,622,119 A | * | 4/1997 | Hsieh | 108/115 |
| 5,640,912 A | * | 6/1997 | Diffrient | 108/50.02 |
| 5,927,214 A | * | 7/1999 | Schwartz et al. | 108/50.02 |
| 6,041,723 A | * | 3/2000 | Peterson | 108/115 |
| 6,082,838 A | * | 7/2000 | Bissu-Palombo | 108/50.01 |
| 6,336,414 B1 | * | 1/2002 | Stewart et al. | 108/50.02 |
| 6,415,723 B1 | * | 7/2002 | Kopish et al. | 105/50.02 |

FOREIGN PATENT DOCUMENTS

EP 481878 * 4/1992

* cited by examiner

*Primary Examiner*—Jose V. Chen
(74) *Attorney, Agent, or Firm*—John A. Miller, Esq.; Warn, Burgess & Hoffman, P.C.

(57) ABSTRACT

A foldable table for use as a computer system workstation. The table includes an enclosure having opposing top and bottom panels, opposing front and back flanges and opposing end panels. A first rear leg is pivotally coupled to the top panel adjacent one end panel and a second rear leg is pivotally coupled to an opposite end of the top panel adjacent the other end panel. Both rear legs include a channel defined by opposing side walls. A first top support arm and a first front leg are pivotally coupled to the first rear leg, and a second top support arm and a second front leg are pivotally coupled to the second rear leg proximate the top panel. The first support arm and the first front leg are partially stored within the channel in the first rear leg, and the second support arm and the second front leg are partially stored within the channel in the second rear leg. An electrical outlet strip is rigidly mounted to an inside surface of the bottom panel.

20 Claims, 4 Drawing Sheets

WORKHORSE TABLE BASE

BACKGROUND OF THE INVENTION

1. Field of the Invention

This invention relates generally to a foldable table and, more particularly, to a table base that includes hinged legs and support arms so that the table is readily foldable into a compact size for carrying and storage.

2. Discussion of the Related Art

Computer systems are valuable and important devices for both home and work. A typical computer system includes a computer tower, a monitor, a keyboard, a mouse and a sound system. Several of these computer system components, as well as other computer accessories, require electrical power, and thus include their own power cable. Therefore, an electrical outlet strip including several electrical outlets is typically used in connection with the computer system so that each of the computer components can be plugged into an outlet to deliver the necessary power thereto. However, the various power cables and other electrical cables associated with the computer system often times are in disarray and are unsightly. Thus, a need exists to collect and organize the computer cables.

Tables specially made for computer systems are known in the art that accommodate the various computer system components and cables. Sometimes there is a need to provide a computer table that is foldable to a flat position to be readily shipped, stored and carried. Further, it is desirable that the table be pre-assembled for ease of set up. Also, it is desirable that the table be capable of accommodating the many power cables and data lines associated with the computer system.

SUMMARY OF THE INVENTION

In accordance with the teachings of the present invention, a foldable table base is disclosed that has particular application to be used in connection with a computer system workstation. The table base includes an enclosure having opposing top and bottom panels, opposing front and back flanges and opposing end panels. A first rear leg is pivotally coupled to the top panel adjacent to one end panel and a second rear leg is pivotally coupled to the top panel adjacent to the other end panel. Both the first rear leg and the second rear leg include a channel defined by opposing side walls. A first top support arm and a first front leg are pivotally coupled to the first rear leg proximate the top panel. Likewise, a second top support arm and a second front leg are pivotally coupled to the second rear leg proximate the top panel. The bottom panel is pivotally coupled to the front flange. An electrical outlet strip is rigidly mounted to an inside surface of the bottom panel. The bottom panel includes selectively placed openings so that power cables can extend therethrough.

When the table is set up, the first and second rear legs, the first and second front legs and the first and second support arms are in their extended and locked position. The front and rear legs are positioned on the floor and the first and second support arms extend parallel thereto. Also, the first and second support arms are positioned within slots in the back flange for lateral stability. Thus, a table top can be positioned on the top panel and the support arms to provide a support for the computer system components. The bottom panel is in a closed position, where the various computer power cords extend through the openings in the bottom panel to be plugged into the electrical strip.

When folding the table for storage or the like, the table top is removed and the bottom panel is opened. The first support arm and the first front leg are unlocked and pivoted so that they align with the first rear leg and are partially positioned in the channel. The first rear leg is then folded into the enclosure so that it is substantially flush with the top panel. Likewise, the second support arm and the second front leg are unlocked and pivoted so that they align with the second rear leg and are partially positioned within the channel. The second rear leg is then folded into the housing so that it is substantially flush with the top panel. The back panel is then closed and locked to the front flange.

Additional objects, advantages and features of the present invention will become apparent from the following description and appended claims, taken in conjunction with the accompanying drawings.

DETAILED DESCRIPTION OF THE EMBODIMENTS

The following discussion of the embodiments of the invention directed to a foldable table is merely exemplary in nature, and is in no way intended to limit the invention or its applications or uses. Particularly, the discussion below describes the table for use as a computer workstation. However, as will be appreciated by those skilled in the art, the table of the invention has uses for many other applications.

Figure 1:
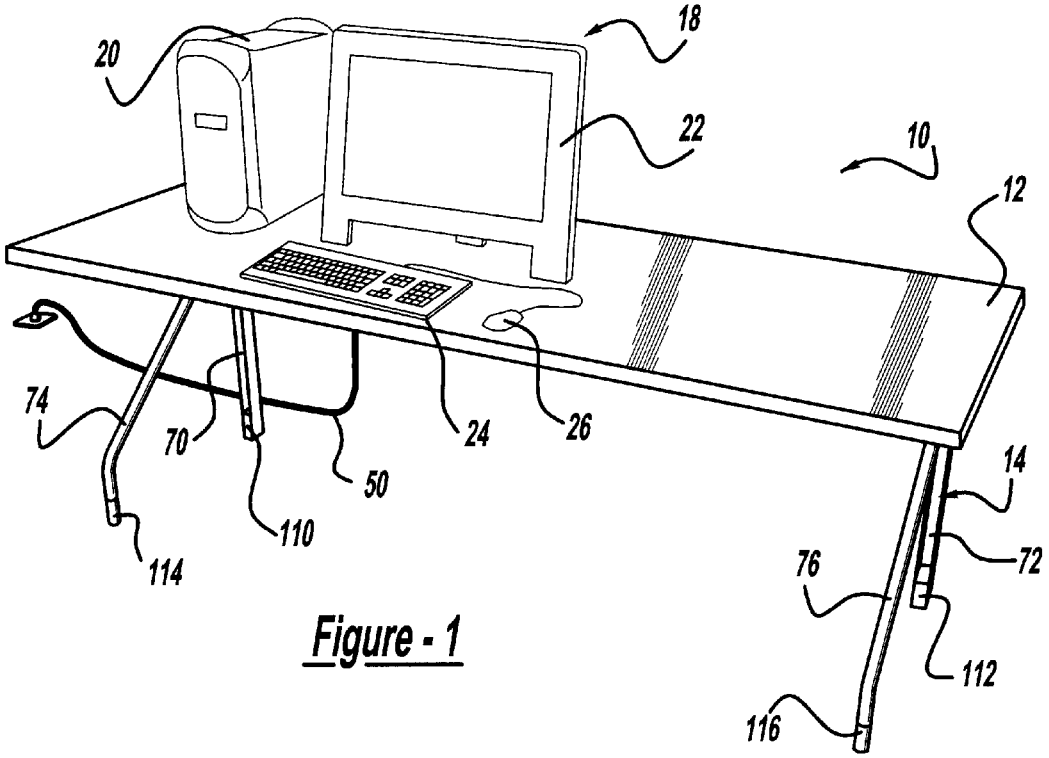
FIG. 1 is a perspective view of a foldable computer table in its workstation position, according to an embodiment of the present invention.

FIG. 1 is a front perspective view of a table 10 including a table top 12 and a foldable table support assembly 14, according to an embodiment of the present invention, where the table assembly 14 is shown in its unfolded and useable position. The top 12 can be secured to the table assembly 14 in any suitable manner. For example, if the table top 12 is glass it can be laid on the table assembly 10 and held there by gravity. If the table top 12 is made of wood, it can be secured to the table assembly 14 by bolts, screws or the like. The various elements that make up the table assembly 14 discussed herein can be made of any suitable material, such as steel or aluminum.

In this embodiment, the table 10 is used as a computer workstation, where a computer system 18 is positioned on the table top 12. The computer system 18 includes a computer tower 20, a monitor 22, a keyboard 24 and a mouse 26. However, the table 10 can accommodate other computer system components and accessories, as well as other systems.

Figure 2:
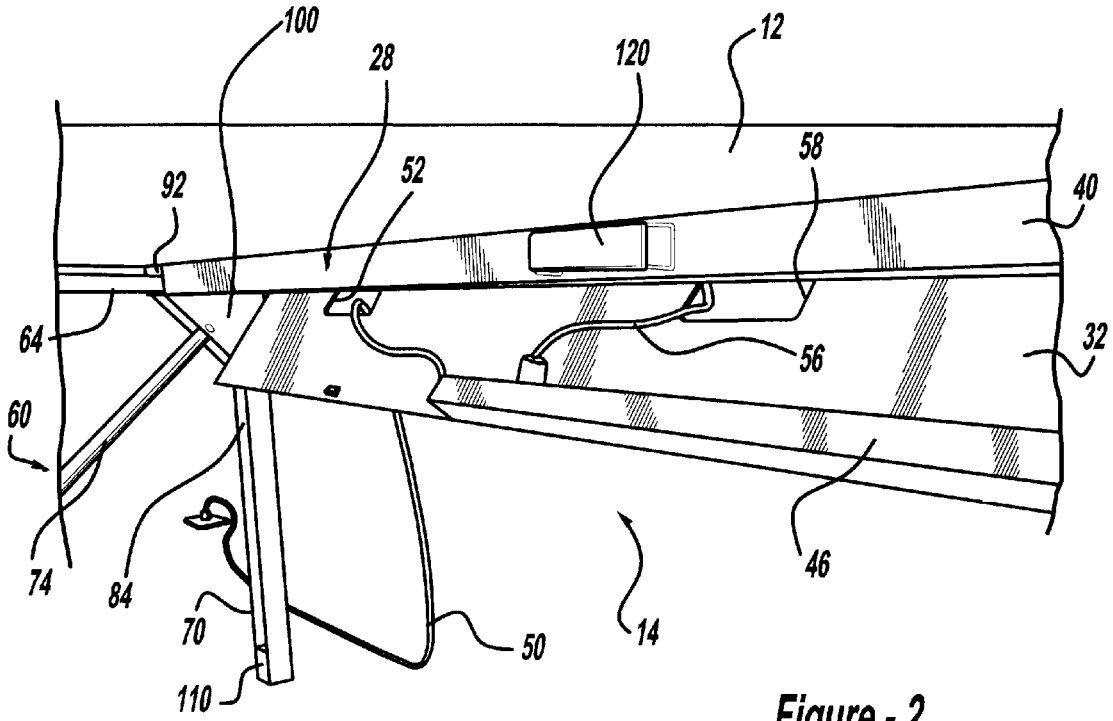
FIG. 2 is a broken-away, close-up, bottom perspective view of the table of the invention shown in FIG. 1.
Figure 3:
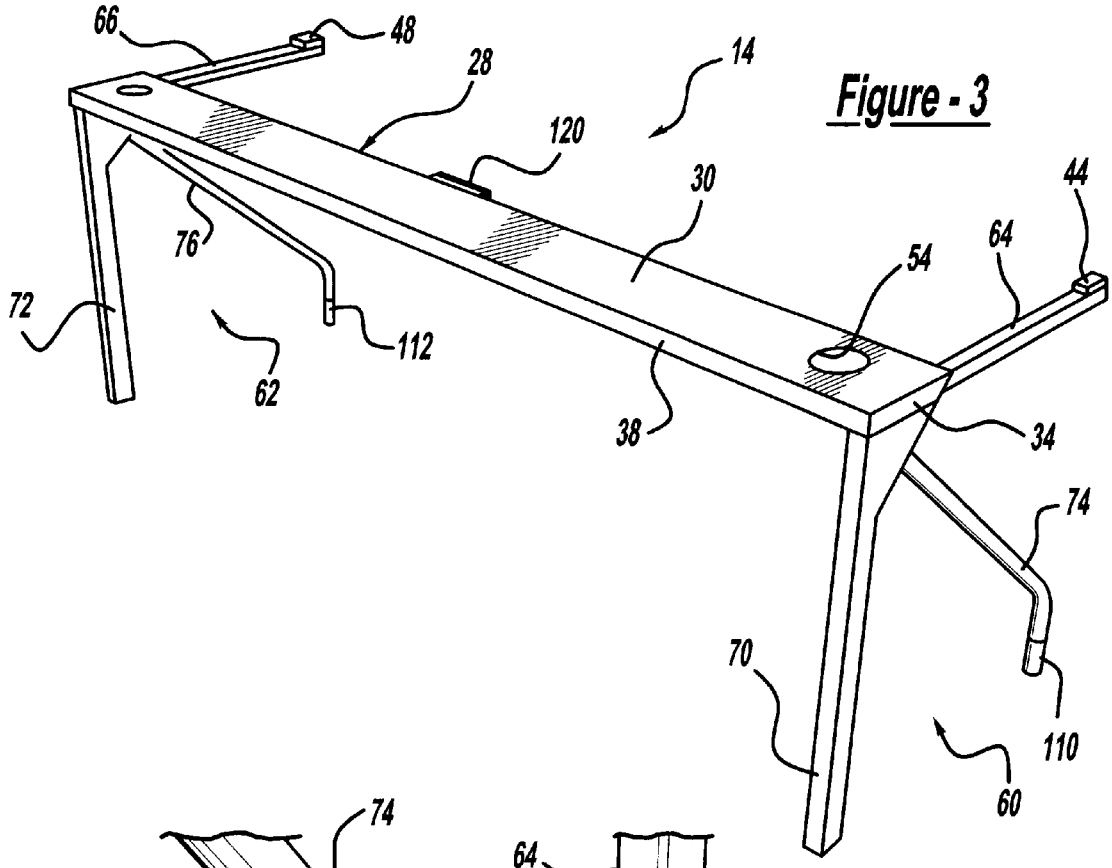
FIG. 3 is a rear perspective view of the table shown in FIG. 1 with the top removed.
Figure 4:
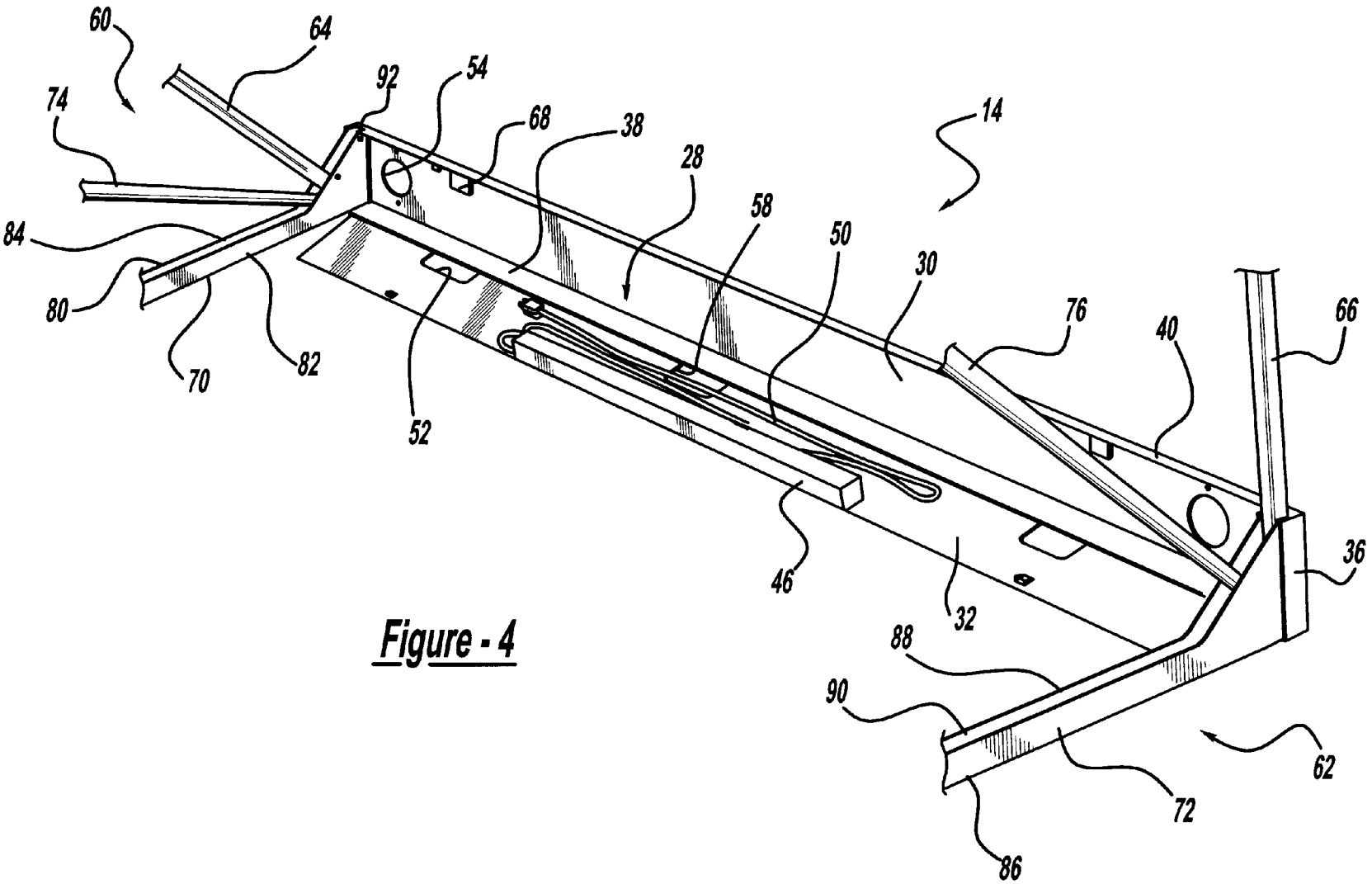
FIG. 4 is a broken-away, perspective view of the table shown in FIG. 3, where the table is laying on its back and one leg assembly is in a partially folded position.

As will be discussed in detail herein, the table assembly 14 is foldable into a compact position for ease of carrying and storage. FIG. 2 is a close-up, bottom perspective view of the table 10, FIG. 3 is a rear perspective view of the table assembly 14 with the table top 12 removed, and FIG. 4 is a perspective view of the table assembly 14 on it's back. The table assembly 14 includes an elongated rectangular enclosure 28 defined by opposing top and bottom panels 30 and 32, opposing end panels 34 and 36, and opposing front and rear flanges 38 and 40. Holes 16 are provided in the top panel 30 to allow the table top 12 to be secured thereto by bolts or the like. The bottom panel 32 is pivotally mounted to the front flange 38 by a suitable hinge 42. In alternate embodiments, several hinges can be used to mount the bottom panel 32 to the front flange 38. The various panels and flanges that make up the enclosure 28 as discussed herein can be formed by suitably bending a piece of metal to the desired configuration, or securing separate pieces of metal together by welding or the like.

FIGS. 2 and 4 show the bottom panel 32 in an open position to expose the inside of the enclosure 28. As is apparent, an electrical outlet strip 46 is rigidly secured to an inside surface of the bottom panel 32. An electrical cord 50 associated with the electrical strip 46 extends through an opening 52 in the bottom panel 32 to be plugged into a wall outlet or the like. Likewise, an electrical cable 56 associated with the computer system 18 extends through another opening 58 in the bottom panel 32 and is plugged into the electrical strip 46. The electrical strip 46 can accommodate several other electrical cords associated with the computer system 18 or other electrical devices. Further, the strip 46 can accommodate data ports, or another data port device can be provided within the enclosure 28. A phone line (not shown) would extend from the strip 46 or data port device to a wall phone outlet for this purpose. Thus, much of the length of the cables associated with the computer system 18 are housed within the enclosure 28 when the panel 32 is closed. Other openings 54 are provided in the top panel 30 to accommodate cables and data lines if desirable. A closure device 68, such as a magnetic strip, snap device, etc., is provided to hold the bottom panel 32 in the closed position.

The table assembly 14 further includes a left leg assembly 60 and a right leg assembly 62. The left leg assembly 60 includes a first rear leg 70, a first top support arm 64 and a first curved front leg 74. The right leg assembly 62 includes a second rear leg 72, a second top support arm 66 and a second curved front leg 76. The first rear leg 70 includes opposing side walls 80 and 82 defining a channel 84 therebetween. Likewise, the second rear leg 72 includes opposing side walls 86 and 88 defining a channel 90 therebetween. The first rear leg 70 includes a foot member 110, the second rear leg 72 includes a foot member 112, the first front leg 74 includes a foot member 114 and the second front leg member includes a foot member 116, all made of a suitable resilient material to prevent damage to the floor. The first support arm 64 and the second support arm 66 support the table top 12 in combination with the top panel 30. The support arm 64 includes a padded member 44 and the support arm 66 includes a padded member 48 to align and cushion the table top 12.

As will be discussed in greater detail below, the first support arm 64 and the first front leg 74 are pivotally coupled to the first rear leg 70 by suitable hinges (not shown) proximate the top panel 30, so that when the table assembly 14 is in the stored position, the first support arm 64 and the first front leg 74 are partially positioned within the channel 84. Likewise, the second support arm 66 and the second front leg 76 are pivotally coupled to the second rear leg 72 by suitable hinges (not shown) proximate the top panel 30, so that when the table assembly 14 is in the stored position, the second support arm 66 and the second front leg 76 are partially positioned within the channel 90. FIG. 4 shows the support arm 66 and the leg 76 in a fully extended and locked position and the support arm 64 and the leg 74 in a partially folded position.

Figure 5:
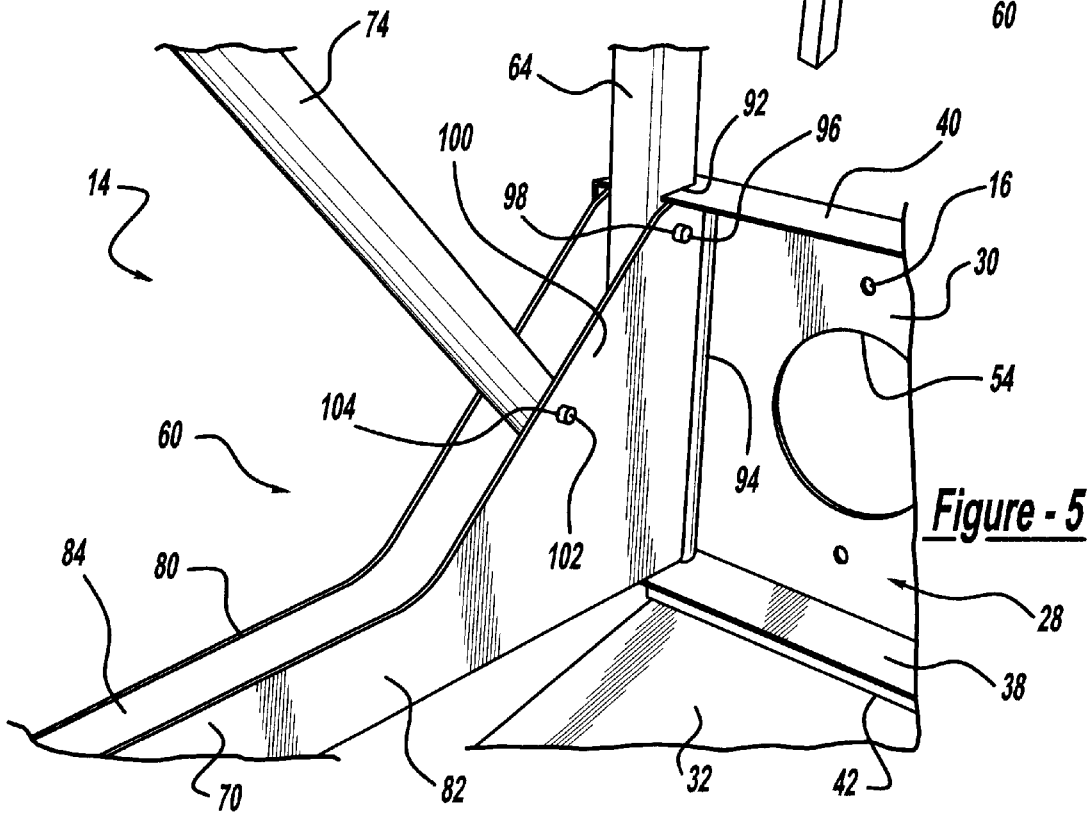
FIG. 5 is a close-up perspective view of one leg assembly of the table shown in FIG. 2 with a front leg and top support arm in an open and locked position.

FIG. 5 is close up perspective view of the area of the table assembly 14 where the first support arm 64 and the first front leg 74 are coupled to the first rear leg 70. When the first support arm 64 is fully extended, a spring-loaded pin 96 attached to the first support arm 64 aligns with and extends through a hole 98 in an extended area 100 of the side wall 82. Further, the support arm 64 extends through a notch 92 in the rear flange 40 to provide lateral stability. Likewise, when the front leg 74 is in its fully extended position, a spring-loaded pin 102 attached to the front leg 74 aligns with and extends through a hole 104 in the extended area 100 of the side wall 82. In this position, the support arm 64 and the front leg 74 are locked in place for use. When the first support arm 64 and the front leg 74 are folded, the pins 96 and 102 are pressed in so that they clear the holes 98 and 104, respectively, to allow the first support arm 64 and the first front leg 74 to be pivoted. The second support arm 66 and the second front leg 76 are secured to the second rear leg 72 in the same manner.

Figure 6:
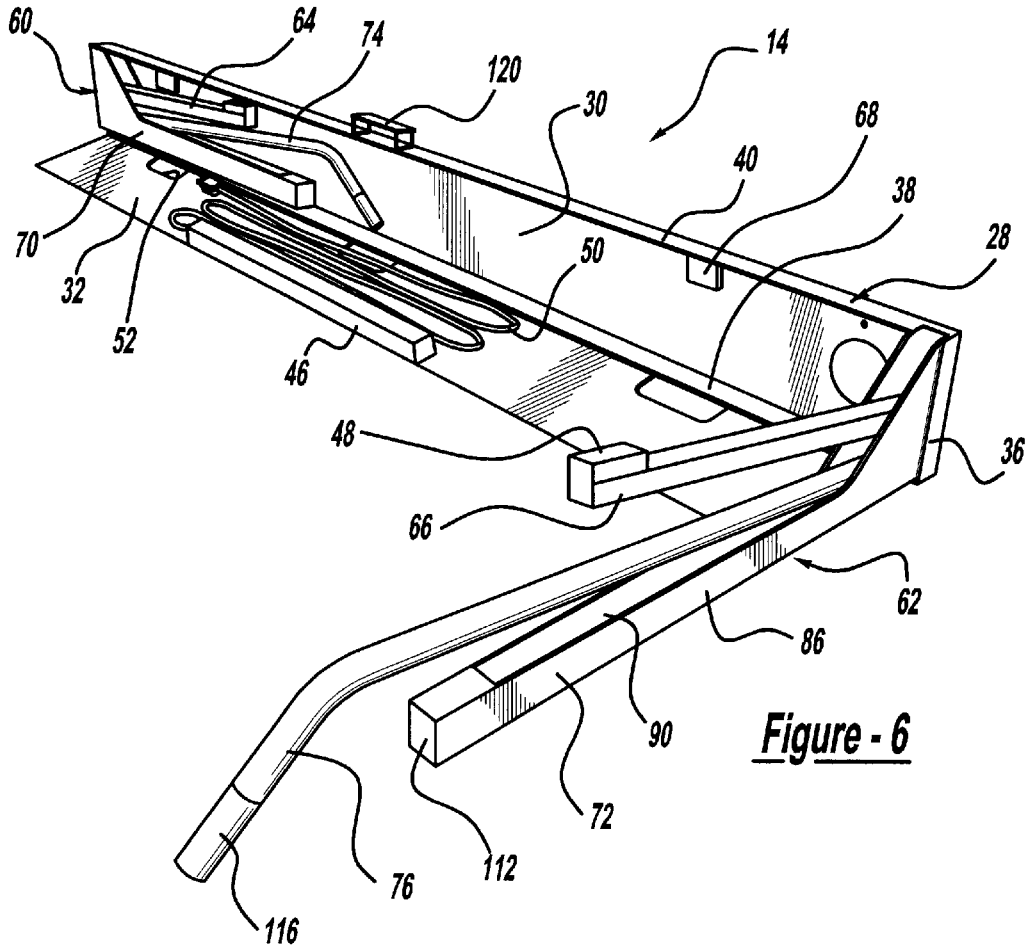
FIG. 6 is a perspective view of the table of the invention where one of the leg assemblies is completely folded, one of the leg assembly is partially folded and the bottom panel is open.

FIG. 6 is a perspective view of the table assembly 10 where the leg assembly 60 is completely folded into the enclosure 28 and the leg assembly 62 is partially folded. The bottom panel 32 is open to show the leg assembly 60 therein. When the first support arm 64 and the first front leg 74 have been folded to the position shown in FIG. 6, then the first rear leg 70 is pivoted lengthwise relative to the enclosure 28 on a hinge 94 so that the complete leg assembly 60 is positioned within the enclosure 28. The leg assembly 62 folds in the same manner.

Figure 7:
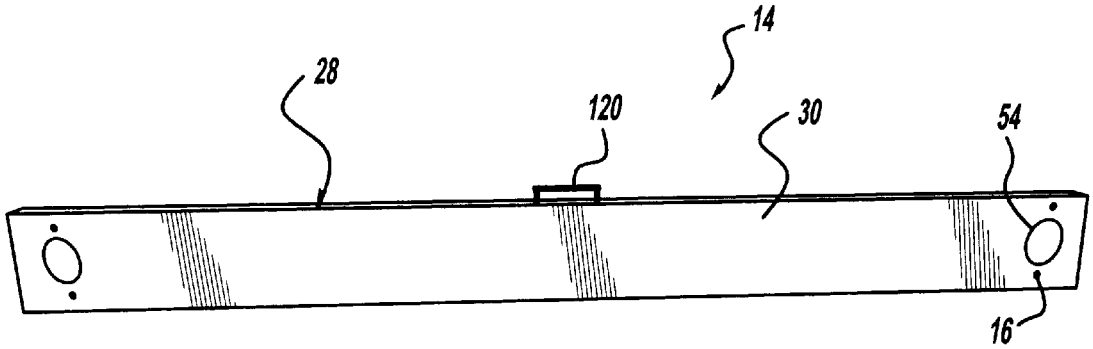
FIG. 7 is a front view of the table of the invention in a completely closed position.

FIG. 7 is a front view of the table assembly 14 with the bottom panel 32 in the closed position. As is apparent, the table assembly 14 can be completely folded into a compact and flat position for easy storage and shipping. A handle 120 is provided to carry the table assembly 14 in the folded position. Further, the table assembly 14 comes in a pre-assembled condition for ease of assembly.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A table assembly comprising:

an enclosure, said enclosure including a top panel, a bottom panel, a first end panel, a second end panel, a front panel and a rear panel, said bottom panel being pivotally mounted to the front panel;

a first leg assembly pivotally coupled to an inside surface of the top panel proximate the first end panel, said first leg assembly including a first rear leg, a first support arm pivotally mounted to the first leg assembly and a first front leg pivotally mounted to the first leg assembly; and a second leg assembly pivotally coupled to an inside surface of the top panel proximate the second end panel, said second leg assembly including a second rear leg, a second support arm pivotally mounted to the second leg assembly and a second front leg pivotally mounted to the second leg assembly, wherein the first leg assembly and the second leg assembly are foldable to be fully positioned within the enclosure and unfoldable to provide a table top support, and wherein the bottom panel is opened and closed to remove and insert the first and second leg assemblies.

2. The table assembly according to claim 1 wherein the first rear leg includes a channel defined by opposing side walls and the second rear leg includes a channel defined by opposing side walls.

3. The table assembly according to claim 2 wherein the first front leg and the first support arm are pivotally coupled to the first rear leg in a manner that allows them to be partially positioned within the channel of the first rear leg, and wherein the second support arm and the second front leg are pivotally coupled to the second rear leg in a manner that allows them to be partially positioned within the channel of the second rear leg.

4. The table assembly according to claim 1 wherein the first support arm, the second support arm and the top panel define a platform for supporting a table top.

5. The table assembly according to claim 1 wherein the first leg assembly includes locking devices to lock the first support arm and the first front leg in an open position, and wherein the second leg assembly includes locking devices to lock the second support arm and the second front leg in an open position.

6. The table assembly according to claim 5 wherein the locking devices are spring-loaded pins that align and extend through cooperating holes.

7. The table assembly according to claim 1 further comprising an electrical outlet strip including a plurality of electrical outlets and/or data ports, said electrical outlet strip being rigidly mounted to an inside surface of the bottom panel.

8. The table assembly according to claim 7 wherein the bottom panel includes at least one opening to accommodate an electrical cord of the electrical outlet strip or a data line.

9. The table assembly according to claim 4 wherein the table assembly and the table top combine to be a computer table assembly.

10. A foldable table assembly comprising:

an elongated rectangular enclosure, said enclosure including a top panel, a bottom panel, a first end panel, a second end panel, a front panel and a rear panel, said bottom panel being pivotally mounted to the front panel;

an electrical outlet strip including a plurality of electrical outlets rigidly mounted to an inside surface of the bottom panel;

a first leg assembly, said first leg assembly including a first rear leg pivotally coupled to an inside surface of the top panel proximate the first end panel, a first front leg pivotally mounted to the first rear leg and a first support arm pivotally mounted to the first rear leg, wherein the first rear leg includes a channel defined by opposing side walls, and wherein the first front leg and the first support arm are foldable to be partially positioned within the channel of the first rear leg; and a second leg assembly, said second leg assembly including a second rear leg pivotally coupled to an inside surface of the top panel proximate the second end panel, a second front leg pivotally mounted to the second rear leg and a second support arm pivotally mounted to the second rear leg, wherein the second rear leg includes a channel defined by opposing side walls and wherein the second front leg and the second support arm are foldable to be partially positioned within the channel of the second rear leg.

11. The table assembly according to claim 10 wherein the first leg assembly and the second leg assembly are foldable to be fully positioned within the enclosure and unfoldable to provide a table top support, and wherein the bottom panel is opened and closed to remove and insert the first and second leg assemblies.

12. The table assembly according to claim 10 wherein the first support arm, the second support arm and the top panel define a platform for supporting a table top.

13. The table assembly according to claim 10 wherein the first leg assembly includes locking devices to lock the first support arm and the first front leg in an open position, and wherein the second leg assembly includes locking devices to lock the second support arm and the second front leg in an open position.

14. The table assembly according to claim 13 wherein the locking devices are spring-loaded pins that align and extend through cooperating holes.

15. The table assembly according to claim 10 wherein the table assembly is part of a computer table assembly.

16. A table base comprising:

an enclosure;

a first leg assembly pivotally coupled to an inside surface of the enclosure, said first leg assembly including a first leg and a second leg, wherein the first leg assembly is pivoted relative to the enclosure to become completely housed therein, said first leg assembly further including a first support arm pivotally coupled to the first leg assembly to be housed in the enclosure in a folded position; and a second leg assembly pivotally coupled to an inside surface of the enclosure, said second leg assembly including a third leg and a fourth leg, wherein the second leg assembly is pivoted relative to the enclosure to become completely housed therein, said second leg assembly further including a second support arm pivotally coupled to the second leg assembly to be housed in the enclosure in a folded position, and wherein the first support arm, the second support arm and the enclosure combine to provide a support for a table top.

17. The table base according to claim 16 wherein the first leg includes a channel defined by opposing side walls and the third leg includes a channel defined by opposing side walls, and wherein the second leg and the first support arm are pivotally coupled to the first leg in a manner that allows them to be partially positioned within the channel of the first leg, and wherein the second support arm and the fourth leg are pivotally coupled to the third leg in a manner that allows them to be partially positioned with the channel of the third leg.

18. The table base according to claim 16 further comprising an electrical output strip including a plurality of electrical outlets and/or data ports, said electrical outlet strip being rigidly mounted to an inside surface of the enclosure.

19. The table base according to claim 16 wherein the enclosure includes a panel pivotally coupled thereto to allow access into the enclosure.

20. The table base according to claim 16 wherein the first leg assembly includes locking devices to lock the first support arm, the first leg and the second leg in an open position, and wherein the second leg assembly includes locking devices to lock the second support arm, the third leg and the fourth leg in an open position.

* * * * *